United States Patent [19]

Bishop et al.

[11] Patent Number: 4,912,862

[45] Date of Patent: Apr. 3, 1990

[54] BACKFILL MACHINE

[76] Inventors: William B. Bishop, P.O. Box 517, Flagstaff, Ariz. 86002; Francis G. Davies, 8400 N. Highway 89, Flagstaff, Ariz. 86004

[21] Appl. No.: 294,359

[22] Filed: Jan. 9, 1989

[51] Int. Cl.[4] ..... E02F 1/00

[52] U.S. Cl. ..... 37/142.5; 37/82; 37/190; 171/15; 171/123; 405/104

[58] Field of Search ..... 37/81, 82, 142.5, 189, 37/190, 252, 1, 104; 171/15, 16, 70, 71, 123, 18; 405/179; 198/513, 518; 414/528, 526, 503–505, 679

[56] References Cited

U.S. PATENT DOCUMENTS

| | | | |
|---|---|---|---|
| 2,653,701 | 9/1953 | Heth | 37/252 X |
| 2,669,338 | 2/1954 | Kling | 37/190 |
| 2,857,691 | 5/1961 | Curran | 37/142.5 |
| 3,503,450 | 3/1970 | Day | 37/142.5 |
| 3,596,384 | 8/1971 | Neujahr | 37/142.5 |
| 3,872,929 | 3/1975 | Theurer et al. | 171/16 |
| 3,903,624 | 9/1975 | Holl | 37/142.5 X |
| 4,116,014 | 4/1983 | Satterwhite | 37/96 |
| 4,123,857 | 11/1978 | Enters et al. | 37/252 |
| 4,193,636 | 3/1980 | Jakob | 37/190 X |
| 4,479,439 | 10/1984 | Theurer et al. | 37/104 X |
| 4,633,602 | 1/1987 | Layh et al. | 37/195 |
| 4,664,791 | 5/1987 | McClain et al. | 37/142.5 X |

FOREIGN PATENT DOCUMENTS

| | | | |
|---|---|---|---|
| 751892 | 7/1980 | U.S.S.R. | 37/252 |

*Primary Examiner*—Randolph A. Reese
*Assistant Examiner*—Franco Deliguori
*Attorney, Agent, or Firm*—M. David Shapiro

[57] ABSTRACT

The invention comprises a mobile backfilling machine wherein raw materials located adjacent an excavated trench are picked up, graded and delivered to the open trench in an order of size grading from finest to coarsest, thereby providing a fine material padding for a product which has been placed into the trench. The machine may also be used to place a warning ribbon into the trench at a point above the padding.

12 Claims, 2 Drawing Sheets

FIG. 1
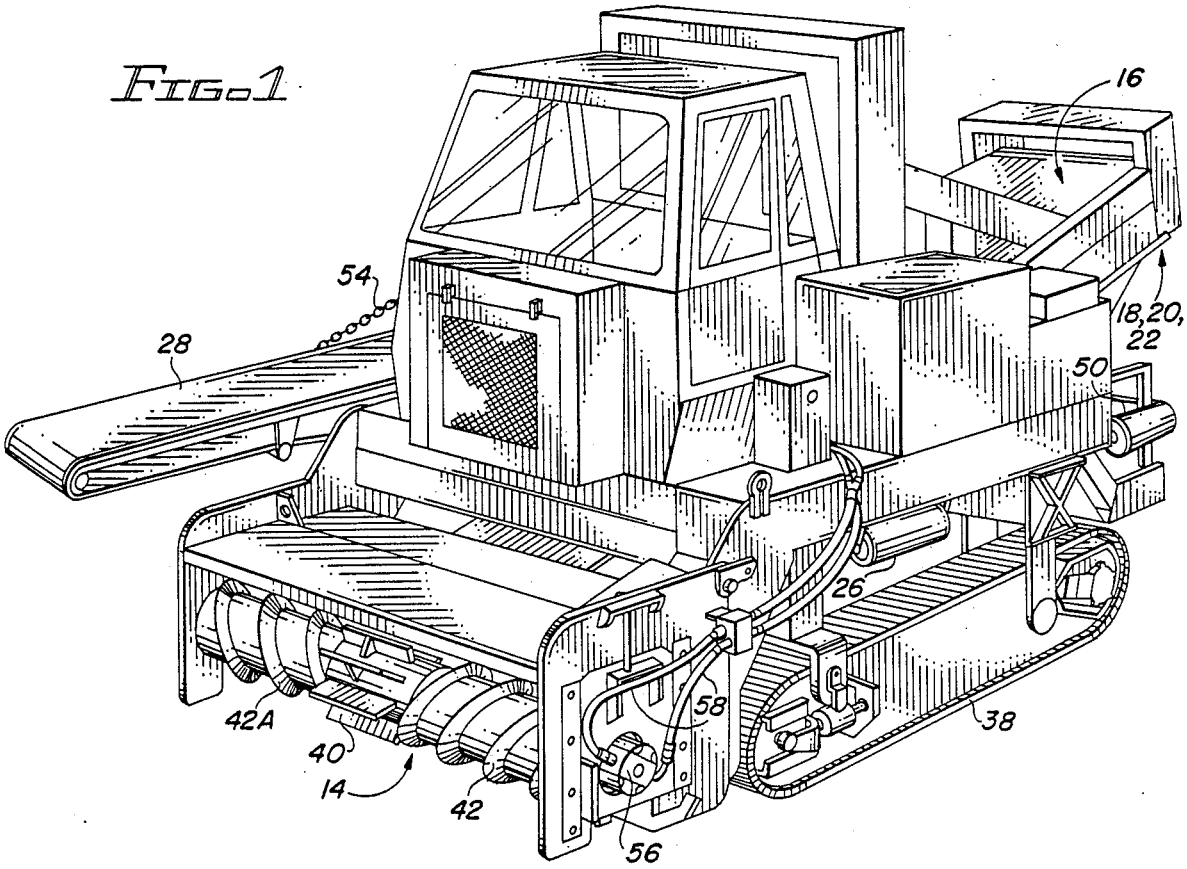
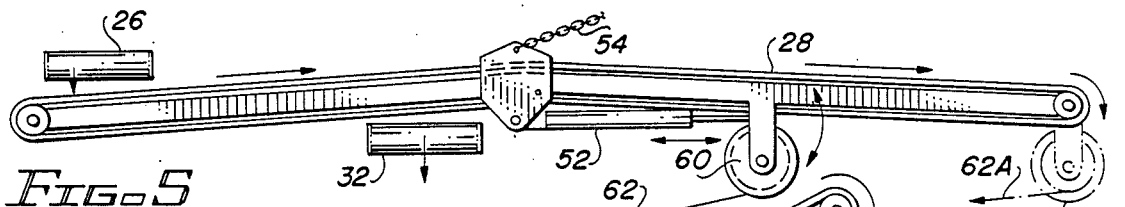
FIG. 5
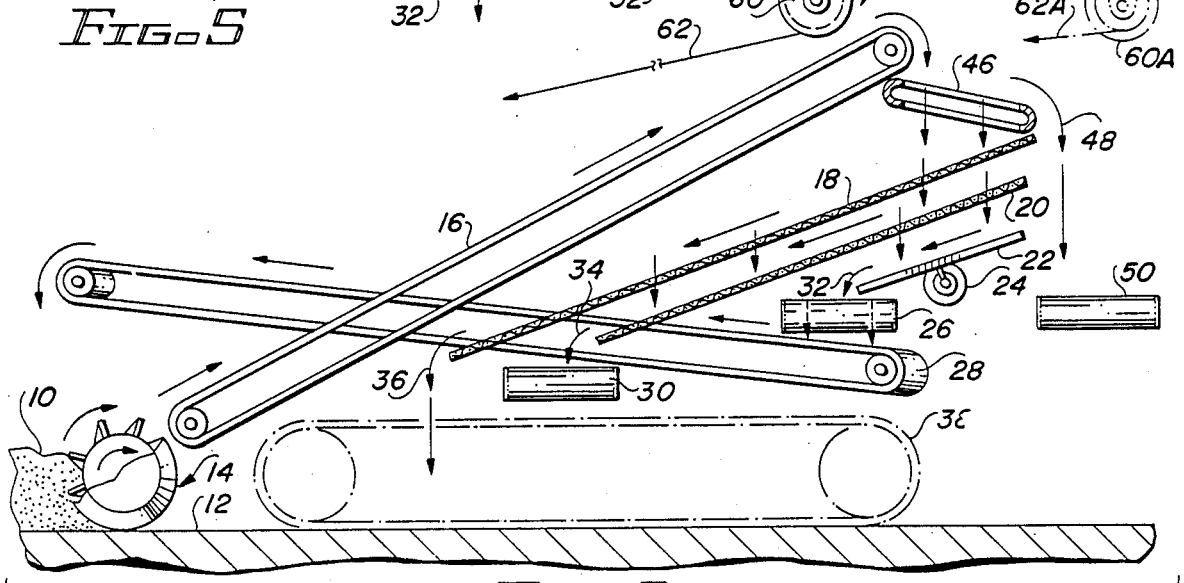
FIG. 2

BACKFILL MACHINE

FIELD OF THE INVENTION

The invention relates to a machine for backfilling a trench which initially requires a layer of relatively fine backfill material and then can tolerate one or more layers of a courser grade or grades of backfill.

BACKGROUND OF THE INVENTION

Until recent years, it was the general practice to backfill nearly all trenches with whatever material was dug out of the ground to make the trench. However, it has lately become the practice to lay plastic pipe containing relatively fragile products, including fiber optic lines, and other fragile materials in trenches and it has been found that if the initial backfill material is of a fine material (called "padding"), the fragile pipe or the like is better protected from damage from the courser backfill which inevitably follows. Where no suitable fine materials are readily available near at hand, it becomes advantageous to manufacture such materials on-site to avoid excessive transportation costs to bring such materials to the work site. Because much of this trenching work is done in rural areas and over relatively long distances, procurement of fine backfill material from off-site can present significant economic problems.

U.S. Pat. No. 4,633,602 issued to R. L. Leyh et al. for a "Method and Apparatus for Padding Pipe" describes a backfill machine which is operated over a berm alongside a trench containing newly laid pipe. It scoops up raw berm material in its path and feeds it by means of a longitudinally aligned conveyor belt to the upper end of a machine mounted screening system located near the after end of the backfill machine The screening system ("separator") is used to separate fine materials from course. A transverse conveyor belt, located beneath the separator, deposits the "fines" back into the trench, thereby "padding" the pipe or the like which has been laid in the trench. The course materials rejected by the separator are deposited on the ground behind the backfill machine adjacent the trench. The course materials are then deposited back into the trench over the fines by a bulldozer, grader or the like which follows along in the backfill machine's path for that purpose.

In U.S. Pat. No. 2,857,691, for a "Pipeline Ditch Filling and Pipe Padding Machine," M. Curran teaches a system intended for mounting on one side of a tractor or the like. It extends, boom-like, across the trench, perpendicular to the vehicle on which it is mounted and comprises a rotary scoop which guides the raw berm material onto a cage-like screening system located at the distal end of an auger/pipe conveyor tube. The fines are conveyed to the inner portion of the cylindrical screen and are transported by the conveyor tube to and through a hole in the bottom of the tube at or near the proximal (vehicle) end; said hole being located by the operator over the trench by steering the vehicle. The disclosure points out that the machine may be used to pad the bottom of the trench before the pipe is laid therein or it may be used for the first covering layer over the laid pipe, or for both functions. The course materials are deposited back to the berm just aft of the pickup point. An auxiliary feed is provided to mix concrete or the like with the fines to provide for stabilizing the mixture and preventing settling thereof.

U.S. Pat. No. 3,596,384, for an "Excavation Refill Packer," issued to R. E. Neujahr, describes a self-propelled machine which uses a belt mounted bucket conveyor which is fed by an off-center auger; that is, it is fed from one side to the longitudinal centerline of the moving machine where the bucket conveyor is mounted. The cup conveyor lifts the raw material from the trench berm to a position over the top of a screening system. A vibrating means for augmenting the screening process is suggested. The screened fines are deposited into the trench aft of the pickup point of the raw material. The chassis of the machine is arranged to be adjustable within a limited angular range with respect to the ground.

U.S. Pat. No. 4,664,791 to McLain et al. teaches yet another trench padding machine. It would appear to be a mobile screening mechanism which is fed from an auxiliary back hoe or the like (a second vehicle having earth moving capability). The screening system is supported over the trench from one side of the carrying vehicle; a tractor or the like. While the raw materials may be collected anywhere, they must be dumped into the hopper by another machine.

U.S. Pat. No. 4,116,014, issued to Satterwhite for an "Excavating and Pipeline Installation System," teaches a tractor/multiple trailer arrangement for excavating a trench, laying a pipeline therein and depositing the raw materials over the laid pipeline. The materials are deposited over the pipeline at the after end of the last trailer, each of which is equipped with a conveyor belt for transporting the material over that trailer's length. There is no teaching of a screening system for generating padding. Each trailer's conveyor belt begins beneath the after end of the conveyor belt of the previous trailer. By canting the belts upward at an after end thereof, this system acts to effectively move the materials from each forward trailer to the next succeeding one aft. Because the entire system straddles the trench which it digs, there is no need for transverse transportation of the materials. The last trailer merely dumps the material back into the trench which lies down the centerline of the combined vehicles.

None of the described apparatus delivers the fine material from a position with respect to the apparatus for producing the fine materials that would permit that same vehicle to also deliver courser materials into a trench over the fines in a single pass.

SUMMARY OF THE INVENTION

These and other problems with prior art inventions are resolved by means of the instant invention in which fines are carried by means of an angled, but generally longitudinal conveyor belt which delivers the fines to a point in the trench which precedes the location of the apparatus used to produce the fines, thereby allowing maximum flexibility with respect to further deposition of courser material directly back into the trench over the already delivered fines. Because of this feature, the machine of the invention is able to deposit as much of the raw material back into the trench as is desired by the operator and the specific operation; up to 100 percent. The machine is angularly adjustable with respect to the ground which allows horizontal orientation, even when operated on reasonably severe grades. Provision is made for as many as four grades of materials to be deposited back into the trench, each in ascending order of size, if desired. The system may be operated from either side of a trench, depending upon the location of the berm containing the raw materials taken from the trench. Provision may be made for laying a warning ribbon between any two layers of fill material to warn future excavators of the proximity of the buried product, whatever it may be. In that way it is to be expected that damage to the buried line may be limited. Further, provision may also be made to mix a stabilizing material or compacting water with the backfill.

Therefore, it is an object of the invention to provide a backfill apparatus which, in a single pass, deposits a plurality of various grades of material back into a trench in predetermined layers according to the size of particles in each grade.

It is another object of the invention to provide a backfill apparatus which, in a single pass, deposits a plurality of various grades of material back into a trench in layers in an ascending order of size of those materials, allowing the operator to completely fill the trench with the same materials which were excavated therefrom to produce the trench at the outset.

It is still another object of the invention to provide a backfill apparatus which provides a means for backfilling a trench in a continuous manner by traveling a path parallel and adjacent to the trench in a single pass, and by screening the berm materials for size grade and by returning the berm material to the trench in layers according to an ascending order of said size grades.

It is yet another object of the invention to provide apparatus capable of collecting raw materials from the ground, sorting those materials according to size grades and then delivering each of such size grades from a different delivery point of the apparatus, all in a single pass of the machine.

These and other objects of the invention will be more readily understood upon study of the Detailed Description of the Preferred Embodiment of the Invention, infra, taken together with the drawings, in which;

FIG. 1 is a three-fourths view of the machine of the invention working alongside a trench on the machine's right side;

FIG. 2 is a left side view of only the material transporting of the invention of FIG. 1;

FIG. 3 is a top view of the material transporting parts of the invention shown in FIG. 2;

FIG. 5 is a right side view of conveyor 28 of FIGS. 2 and 3 and

Figure 3:
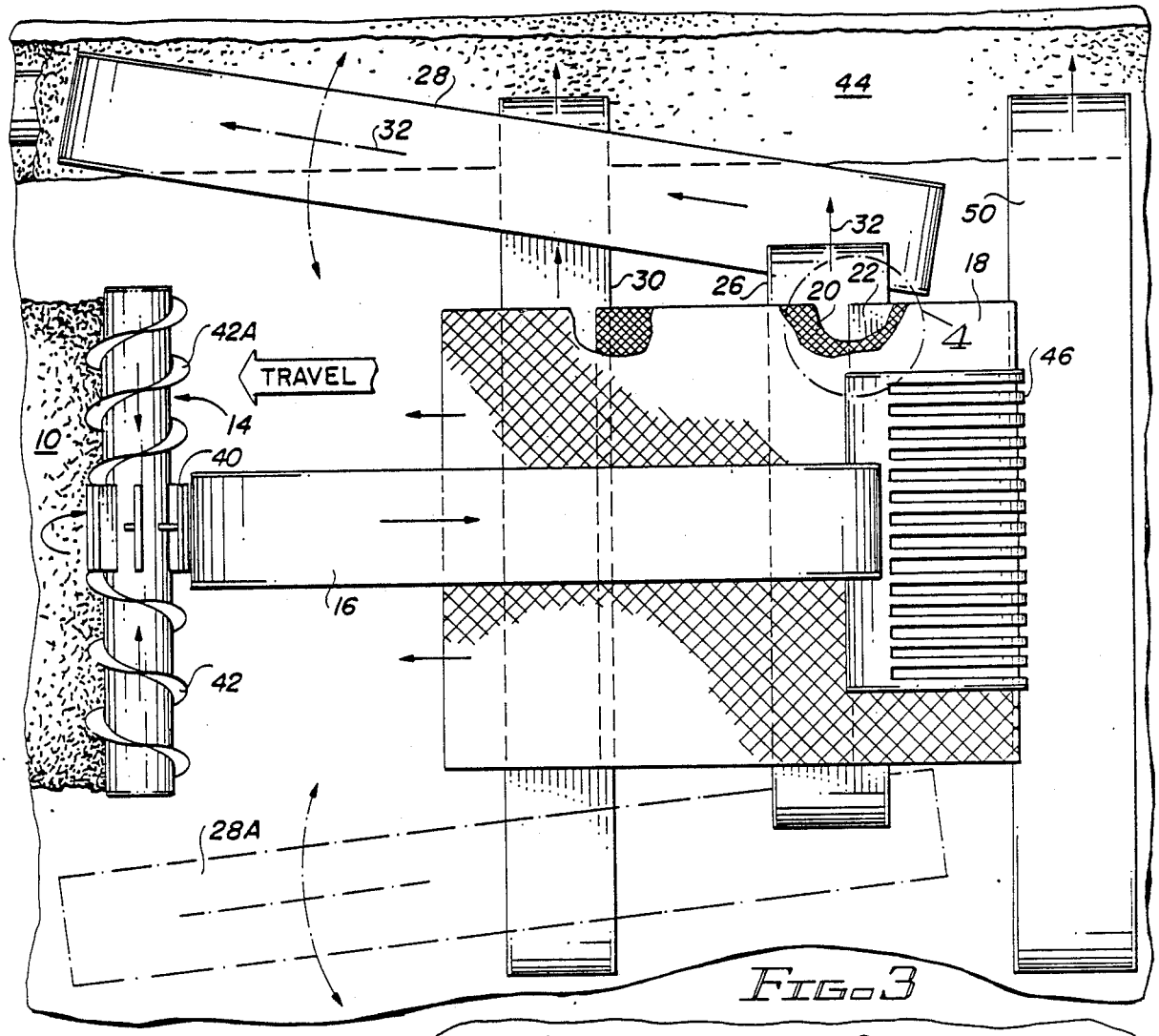
FIG. 3 is

DETAILED DESCRIPTION OF THE PREFERRED EMBODIMENT OF THE INVENTION (It should be noted that wherever in this specification like reference numerals are used they refer to like features of the invention. Wherever an alphabetic suffix is appended to such reference numerals, they indicate a variation of or a different version of the same reference numeral which does not carry such suffix.)

The apparatus of the invention is shown in FIG. 1 in three-fourths view as seen from the left front of the apparatus. In operation, the machine advances to the left of the drawing and is propelled by track assembly 38 actuated by means of hydraulic motor 56. The apparatus as shown is a modified GOMACO concrete laying machine which is used as a carrying vehicle for the back-fill apparatus of the invention. The original concrete laying machine which was modified was a Model GT-6000-90, manufactured by the GOMACO Company, Ida Grove, Iowa 51445. All of the elements used for laying concrete were removed to accommodate the modifications which comprise the instant invention. All moving parts of the machine are driven by a centrally located hydraulic system which is well known and understood by one of ordinary skill in the heavy machinery art.

A single centrally located (not shown) hydraulic pump provides power to a hydraulic cylinder wherever linear motion is desired (exemplified by hydraulic cylinder 52, FIG. 5, used to raise or lower the outboard end of conveyor 28), or to a hydraulically operated rotary motor (exemplified by hydraulic motor 56 of FIG. 1, used to rotate auger 14), where such rotary motion is needed. The hydraulic pump may be driven from a gasoline or diesel engine or any other suitable prime mover (not shown) preferably mounted on the vehicle.

FIGS. 2 and 3 provide an understanding of the backfilling mechanism of the invention. FIGS. 2 and 3 do not show the original GOMACO machine except for track assembly 38 (only in FIG. 2), which is shown in phantom in approximately correct position with respect to the apparatus of the invention. The machine of the invention is intended for operation along a berm line 10, composed of excavated materials from trench 44 and which typically lies parallel to and adjacent such excavated trench 44 (see. FIG. 3), on ground grade 12. The front of the machine is equipped with auger 14 comprising left-hand auger 42, right-hand auger 42A (the opposite hand from left-hand auger 42), and paddle assembly 40. Auger assembly 14 is rotated clockwise as viewed from its left end (the end shown in FIGS. 1 and 2). Raw material from berm IO is moved toward the center of the machine by opposed augers 42, 42A where it is picked up by paddles 40 and transferred to conveyor belt 16. (The arrows in FIGS. 2, 3 and 6 indicate material flow.)

Conveyor 16 lifts the raw material upward and to the rear of the machine of the invention. At the after end of conveyor 16, the raw material is gravity transferred to grizzly bars 46 (a multiple tined fork arrangement) used to provide a first very course screening of the raw material to remove larger rock size portions. Of course, it will be understood that the tine spacing on grizzly bars 46 may be adjusted to provide any degree of screening desired. The course material 48 rolls off the rear of grizzly 46 and is fed by gravity to conveyor belt 50 which may be used to transfer the course material back into trench 44. If it is deemed more desirable to eliminate the coarsest materials from the backfill operation, conveyor 50 may be removed and those materials are then returned to the ground behind the advancing machine. It is also possible to place a dump truck or other container behind the advancing machine to collect the coarsest materials for disposal away from the work site.

At this point it may be noted that the three transverse conveyor belts 50, 26 and 30 may be operated in either of two directions so that material may be returned to a trench on either side of the machine of the invention. That is, the machine may be readily adapted for operation on either side of a trench. This is advantageous because trench sites are frequently encountered where there is a barrier of some sort on one side thereof. The example, as shown in the drawings, returns material to trench 44 on the right side of the machine.

Course screen 18 and fine screen 20 are located just below grizzly 46. Collector plate 22 is located just below fine screen 20. Screens 18 and 20 and collector plate 22 are assembled as a unit, but with screens 18 and 20 arranged for easy replacement. This facilitates changing these screens when they are worn or when a different grading of material is desired.

A cylindrical weight 24 is rotatably mounted below and connected to collector plate 22. Weight 24 is mounted on an eccentric axis so that when rotated it imparts a shaking motion to the assembly comprising screens 18 and 20 and to collector plate 22. As are all other devices of the invention, the shaking mechanism is rotated by hydraulic means.

Materials which are small enough to pass through the bars of grizzly 46 fall on screen 18. The shaking motion of eccentric weight 24 urges these materials to flow downward, either toward the front of the machine over the top of screen 18, or through courser screen 18 to finer screen 20. The larger particles 36 flow to the forward end of screen 18 and drop off onto the ground as shown. Of course, it will be understood that another transverse conveyor belt (not shown) could be placed to collect larger particles 36 and shunt them into trench 44. Such a conveyor would be placed just below the end of screen 18. (Because the finer materials generated from screen 20 are delivered aft of the forward end of screen 18, this additional conveyor is not suggested because it is generally more advantageous to use the finest backfill available to fill the trench before using any courser materials. It is clear that even this could be accomplished if the extra conveyor, again, not shown, were to be angled rearward on the trench side; however, in that case, it would have to be pivotable to provide an opposite angle for opposite side use. Another alternative would be to use a transverse conveyor under the end of screen 18 with still another conveyor picking up the output end of that conveyor and delivering the course materials further aft.)

The finer materials which fall through screen 18 pass onto finer screen 20. Here, again, the courser materials 34 are retained above screen 20 while the finer materials 32 pass through to collector plate 22. The relatively courser materials 34 on the top of screen 20 are urged to flow downward toward the front of the machine where they are collected on conveyor belt 30, which carries them to the right of the machine and into trench 44. The finer materials which pass through screen 20 are collected by collector plate 22 and are urged to flow downward, toward the front of the machine, to conveyor belt 26. Conveyor belt 26 conveys the finest materials to the right of the machine where they are transferred by means of gravity to conveyor belt 28. Conveyor 28 carries the finest material, over conveyor 30, to the front of the machine; out in front of the original pickup point of auger assembly 14. (This is best seen in FIG. 3.) It will be understood that conveyor 28 may be attached to the machine on the left side as shown in phantom in FIG. 3 at 28A; conveyor belt 26 may then be reversed and the fine materials would be delivered to conveyor 28A at the left of the machine instead of the right and used to backfill a trench located to the left of berm IO and the machine of the invention.

It should also be understood that conveyor 28 may be swung closer or further away from the machine by its hydraulic controls and may be lifted or lowered at the delivering end. This is shown in FIG. 5 (as viewed from the right side of the machine of FIGS. 1 and 2) where it may be seen that hydraulic cylinder 52 may be actuated for the raising and lowering action.

In operation, then, conveyor 28 places the finest materials into trench 44, first. Conveyor 30 follows with a courser material and the coarsest materials are deposited into the trench, last, or onto the ground, according to the way the machine is set up. It will also be understood that, although the preferred embodiment of the machine, as illustrated in the drawings, delivers the finest material to a point in trench 44 which is forward of pickup auger 14, the critical fact is that the delivery is forward of the apparatus used to separate the finer materials from the courser ones.

The GOMACO concrete laying vehicle was equipped, as manufactured, with hydraulic leveling cylinders for adjusting the machine so that it was parallel to the concrete path being laid. In the application of the instant invention, although the concrete laying capabilities have been removed, the leveling mechanism is used to control apparatus attitude so that it is reasonably horizontal, regardless of the terrain angle with respect to the horizon. The leveling adjustment may be selected either for manual or automatic control. The leveling gear is also used to control the depth of cut into berm material IO by auger assembly 14. This is done by adjusting the height of the front of the machine affecting the vertical position of auger 14. This leveling arrangement also allows the apparatus of the invention to be operated effectively in very rough terrain while maintaining good gravity flow of materials throughout the screening and delivery systems.

Figure 4:
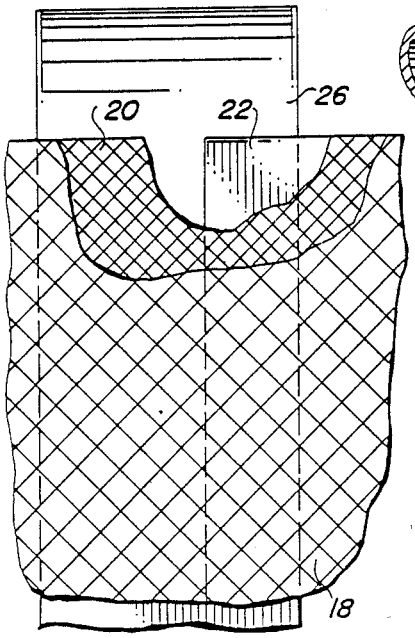
FIG. 4 is a detailed view taken at 4 of FIG. 3.

FIG. 4 illustrates the relationship of screens 18 and 20, collector plate 22 and conveyor 26 in more detail. As is seen in the view of FIG. 2, the forward end of collector plate 22 is positioned to provide some vertical overlap between plate 22 and conveyor 26 to assure that the material coming off the forward end of plate 22 falls onto conveyor 26. Screen 20 continues well forward of plate 22, past the forward side of conveyor 26 to assure that the courser material flowing down the upper side of screen 20 does not fall onto conveyor 26; but rather, continues forward to be delivered to conveyor 30. Screen 18 continues still further forward to assure that its unscreened material load is delivered to the ground, behind auger 14.

Figure 6:
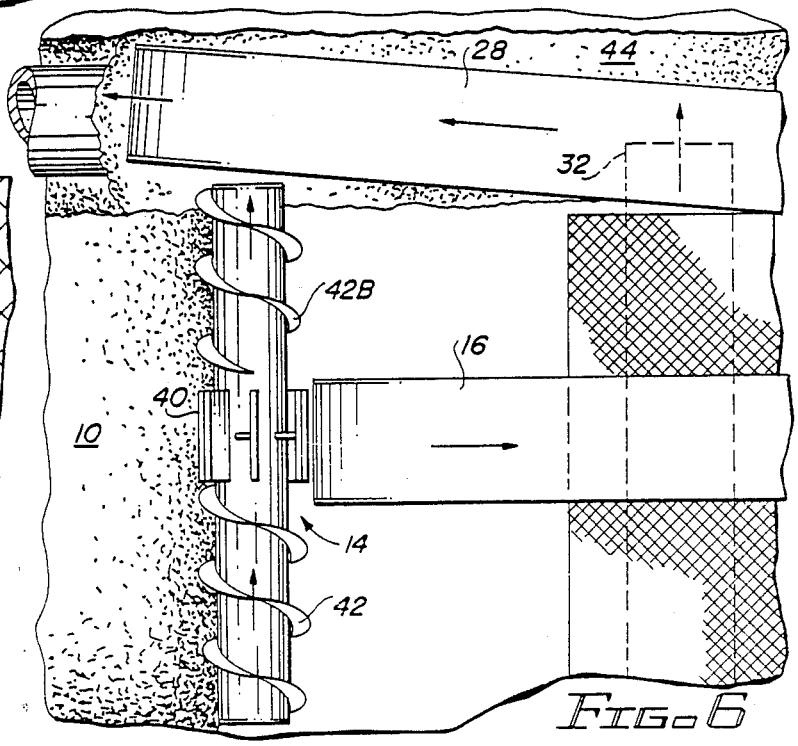
FIG. 6 is a top view of a portion of FIG. 3 showing an alternate design for auger 14 of FIG. 3.

FIG. 6 illustrates a variation in design of auger 14. In that case, both halves of auger 14 are of the same hand. (As shown they are left-handed pitch, but they could both be of right-handed pitch, depending upon the positioning of the machine to either the left or right side of the trench.) By using a single handed auger pitch, nearly half of the berm material would be delivered to the trench as a second layer just above the fine layer delivered by conveyor 28 (28A). That delivery would be of the ungraded raw materials but, in many applications, that would be a useful mode of operation. Auger assembly 14 is readily replaceable on the front of the vehicle and may be easily switched to suit the needs of various job applications. (While the detail is not shown, the auger assembly is mounted by means of two lower engagement lugs and two upper retaining bolts to the chassis of the machine. Actuating power is transmitted by means of two readily disconnected and reconnected flexible hydraulic lines 58 to hydraulic motor 56.)

While the preferred embodiment is described herein with respect to its ability to return graded materials to a trench, it will be understood that because of the flexibility of the machine, it may also be used to deliver materials from the ground to a truck or other conveyance, merely by adjusting the position of the distal end of conveyor belt 28. Raising the distal end of conveyor 28 allows delivery at significant distance above grade level. Conveyor 28 is also adjustable in azimuth, as well as in elevation.

It is advantageous to bury a warning device, such as a brightly colored ribbon, above the padding which covers the buried product. The discovery of such a device by one excavating the fully filled trench would warn that person that digging was getting close to the product which is buried and care should be taken not to damage that buried product. The machine of the invention may be equipped with a dispenser of a ribbon 62, or the like, such as spool 60, both shown in FIG. 5 attached to a convenient place on conveyor 28. Alternatively, spool 6OA may be mounted further forward on the machine, as shown, dispensing ribbon 62A. Of course, ribbon dispenser 60 may be mounted still further aft where ribbon 62 would be buried at a higher level in the trench. While the dispenser 60 may be mounted anywhere along the trench side of the machine, the further aft it is mounted, the higher in the trench its dispensed product will be buried. It will be understood that stabilizers, or the like, may also be dispensed into the trench using similar mounting and dispensing methods. For example, a water source (not shown) may be located anywhere along the trench side of the machine of the invention, or even within the system of transportation conveyors, to mix water with the backfill materials for the purpose of stabilizing the backfill materials.

While the invention has been particularly shown and described herein with reference to a preferred embodiment thereof, it will be understood by those skilled in the art that various other modifications and changes may be made to the present invention from the principles of the invention as herein described without departing from the spirit and scope as encompassed in the accompanying claims. Therefore, it is intended in the appended claims to cover all such equivalent variations which may come within the scope of the invention as described.

What is claimed is:

1. A machine for backfilling an excavated trench, the backfilling machine being adapted for continuous mobile operation over a berm containing raw materials, the berm being adjacent the excavated trench, the backfilling machine comprising:

means for picking up at least a portion of the raw materials from the berm;

means for producing at least one grade of fine material from the raw material;

first means for transporting the raw material from said means for picking up the raw material to said means for producing at least one grade of fine material; and second means for transporting said at least one grade of fine material from said means for producing at least one grade of fine material to a position in the trench at a point which is longitudinally forward of said means for picking up and longitudinally forward of said means for producing said at least one grade of fine material.

2. The backfilling machine according to claim 1 wherein said means for picking up at least a portion of the raw materials from the berm further comprises:

an auger assembly, said auger assembly comprising a left half auger having a left-handed pitch, a right half auger having an right-handed pitch, and a paddle assembly therebetween, said paddle assembly being located adjacent an input end of said first means for transporting, said left half auger, said right half auger and said paddle assembly being mounted on a common axis;

means for engaging said auger assembly with the berm containing the raw materials; and means for rotating said auger assembly in a clockwise direction as viewed from a left side of the backfilling machine.

3. The backfilling machine according to claim 2 wherein said means for picking up at least a portion of the raw material from the berm is positioned at a front end of the backfilling machine.

4. The backfilling machine according to claim 3 wherein each of said first and said second means for transporting comprises at least one conveyor belt.

5. The backfilling machine according to claim 3 wherein said means for producing at least one grade of fine material produces a plurality of graded materials and said second means for transporting comprises:

means for providing a plurality of delivery points into the trench, wherein each of said delivery points corresponds to and delivers a different one of said plurality of graded materials, whereby each of said graded materials is delivered in an order from a front of the backfilling machine to a back of the backfilling machine, respectively, according to an increasing maximum particle size of each of said plurality of graded materials.

6. The backfilling machine according to claim 1 wherein said means for picking up at least a portion of the raw materials from the berm further comprises:

an auger assembly, said auger assembly comprising a left half auger having a first-handed pitch, a right half auger having said first-handed pitch, and a paddle assembly therebetween, said paddle assembly being located adjacent an input end of said first means for transporting, said left half auger, said right half auger and said paddle assembly being mounted on a common axis;

means for engaging said auger assembly with the berm containing the raw materials.

7. The backfilling machine according to claim 6 wherein said means for picking up at least a portion of the raw material from the berm is positioned at a front end of the backfilling machine.

8. The backfilling machine according to claim 1 further comprising:

means for dispensing at least another material into the trench at a predetermined level above the bottom of the trench.

9. The backfilling machine according to claim 1 wherein said means for producing at least one grade of fine material produces a plurality of graded materials and said second means for transporting comprises:

means for providing a plurality of delivery points into said trench, wherein each of said delivery points corresponds to and delivers a different one of said plurality of graded materials, whereby each of said graded materials is delivered in an order from a front of the backfilling machine to a back of the backfilling machine, respectively, according to an increasing maximum particle size of each of said plurality of graded materials.

10. The backfilling machine according to claim 1 wherein said each of said first and said second means for transporting comprises at least one conveyor belt.

11. The backfilling machine according to claim 1 wherein said means for producing said fine material comprises a screening system for separating said fine material from a courser material to produce a plurality of materials graded as to fineness.

12. A machine for backfilling an excavated trench, the backfilling machine being adapted for continuous mobile operation over a berm containing raw materials, the berm being adjacent the excavated trench, the backfilling machine comprising:

means for picking up at least a portion of the raw materials from the berm;

means for producing at least one grade of fine material from the raw material;

first means for transporting the raw material from said means for picking up the raw material to said means for producing at least one grade of fine material; and second means for transporting said at least one grade of fine material from said means for producing at least one grade of fine material to a position in the trench at a point which is longitudinally forward of said means for producing said at least one grade of fine material;

wherein said means for picking up at least a portion of the raw material from the berm further comprises:

an auger assembly, said auger assembly comprising a left half auger having a left-handed pitch, a right half auger having a right-handed pitch, and a paddle assembly therebetween, said paddle assembly being located adjacent an input end of said first means for transporting, said left half auger, said right half auger and said paddle assembly being mounted on a common axis; means for engaging said auger assembly with the berm containing the raw materials; and means for rotating said auger assembly in a clockwise direction as viewed from a left end of said auger assembly.

* * * * *